US009110417B2

(12) United States Patent
Mitani et al.

(10) Patent No.: US 9,110,417 B2
(45) Date of Patent: Aug. 18, 2015

(54) FIXING APPARATUS AND IMAGE FORMING APPARATUS INCLUDING THE FIXING APPARATUS

(71) Applicant: CANON KABUSHIKI KAISHA, Tokyo (JP)

(72) Inventors: Takanori Mitani, Tokyo (JP); Satoshi Nishida, Numazu (JP); Hideo Nanataki, Yokohama (JP); Shogo Kan, Suntou-gun (JP); Takeshi Shinji, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 13/833,784

(22) Filed: Mar. 15, 2013

(65) Prior Publication Data

US 2013/0251424 A1 Sep. 26, 2013

(30) Foreign Application Priority Data

Mar. 21, 2012 (JP) ..... 2012-063662

(51) Int. Cl.
*G03G 15/20* (2006.01)

(52) U.S. Cl.
CPC ..... *G03G 15/2085* (2013.01); *G03G 15/2028* (2013.01); *G03G 15/2053* (2013.01); *G03G 2215/2019* (2013.01)

(58) Field of Classification Search
CPC ..... G03G 15/0868; G03G 15/0874; G03G 15/0882; G03G 15/0898; G03G 15/1695; G03G 15/6576; G03G 21/1676; G03G 2215/0682; G03G 2215/0687; G03G 2215/0875
See application file for complete search history.

(56) References Cited

U.S. PATENT DOCUMENTS

2004/0114975 A1* 6/2004 Sano et al. ..... 399/328

FOREIGN PATENT DOCUMENTS

| | | | |
|---|---|---|---|
| JP | 6-003982 | A | 1/1994 |
| JP | 10-284218 | A | 10/1998 |
| JP | 2004-157524 | A | 6/2004 |
| JP | 2008-140701 | A | 6/2008 |
| JP | 2008-151923 | A | 7/2008 |

* cited by examiner

*Primary Examiner* — Roy Y Yi
(74) *Attorney, Agent, or Firm* — Canon USA Inc IP Division

(57) ABSTRACT

A fixing apparatus includes a roller, a first unit configured to heat the roller, the first unit including a first tubular film, a heating portion forming member to form a heating portion with the roller, and a first guide member dotted with first protruding portions contacting the inner surface of the first tubular film, and a second unit configured to form a nip portion with the roller, the second unit including a second tubular film, a nip portion forming member to form the nip portion with the roller, and a second guide member dotted with second protruding portions contacting the inner surface of the second tubular film, wherein there is a non-overlapping area between the first protruding portions and the second protruding portions in a generatrix direction of the roller.

7 Claims, 12 Drawing Sheets

FIG. 6A

| | HEATING FILM GUIDE | | PRESSURE FILM GUIDE | |
|---|---|---|---|---|
| | UPSTREAM RIB | DOWNSTREAM RIB | UPSTREAM RIB | DOWNSTREAM RIB |
| COMPARATIVE EXAMPLE 1 | POSITION A | POSITION A | POSITION A | POSITION A |
| COMPARATIVE EXAMPLE 2 | POSITION A | POSITION A | POSITION A | POSITION B |
| COMPARATIVE EXAMPLE 3 | POSITION A | POSITION B | POSITION A | POSITION A |
| COMPARATIVE EXAMPLE 4 | POSITION A | POSITION B | POSITION A | POSITION B |

FIG. 6C

| | UNEVEN GLOSS IN ONE-SIDED PRINTING | FIRST SURFACE UNEVEN GLOSS IN TWO-SIDED PRINTING |
|---|---|---|
| COMPARATIVE EXAMPLES 1 TO 4 | △ | × |

○ : VISUALLY UNNOTICEABLE

△ : CLOSE TO VISUAL DETECTION LIMIT

× : EASILY NOTICED VISUALLY

FIG. 7A

| | HEATING FILM GUIDE | | PRESSURE FILM GUIDE | |
|---|---|---|---|---|
| | UPSTREAM RIB | DOWNSTREAM RIB | UPSTREAM RIB | DOWNSTREAM RIB |
| EXEMPLARY EMBODIMENT | POSITION A | POSITION A | POSITION B | POSITION A |
| | POSITION A | POSITION A | POSITION B | POSITION B |
| | POSITION A | POSITION B | POSITION B | POSITION A |
| | POSITION A | POSITION B | POSITION B | POSITION B |

FIG. 7C

| | UNEVEN GLOSS IN ONE-SIDED PRINTING | FIRST SURFACE UNEVEN GLOSS IN TWO-SIDED PRINTING |
|---|---|---|
| EXEMPLARY EMBODIMENT | ○ | ○ |

○ : VISUALLY UNNOTICEABLE

△ : CLOSE TO VISUAL DETECTION LIMIT

× : EASILY NOTICED VISUALLY

FIXING APPARATUS AND IMAGE FORMING APPARATUS INCLUDING THE FIXING APPARATUS

BACKGROUND OF THE INVENTION

1. Field of the Invention

The present invention relates to a fixing apparatus, such as an electrophotographic copying machine and an electrophotographic printer, and an image forming apparatus including the fixing apparatus.

2. Description of the Related Art

As a fixing apparatus used in an electrophotographic copying machine or printer, an external-heating-type fixing apparatus that uses a film is known.

Such an external-heating-type fixing apparatus includes a driven heating roller, a pressure film unit that contacts the heating roller to form a nip portion, and a heating film unit that contacts a fixing roller to form a heating portion.

The heating film unit includes a tubular heating film, a heater that contacts the inner surface of the heating film, and a heating film guide that contacts the inner surface of the heating film and guides the rotation of the heating film. The pressure film unit includes a tubular pressure film and a pressure film guide that contacts the inner surface of the pressure film and guides the rotation of the pressure film.

This fixing apparatus enables the drive torque to be reduced more than a fixed-type external heating unit because the fixing apparatus uses a film that rotates with the heating roller even in an external heating unit.

In this fixing apparatus, the heating film and the pressure film are driven and rotated by driving and rotating the heating roller. Therefore, if the sliding resistance is large at the portion where the heating film guide that guides the rotation of the heating film and the inner surface of the heating film contact, rotation of the heating film can become uneven. Further, the same problem can also occur at the portion where the pressure film and the pressure film guide contact.

If the rotation of the heating film and the pressure film become uneven, the heat supply to the heating roller becomes uneven. Further, if the rotation of the pressure film becomes uneven, conveyance of a recording medium at the nip portion becomes uneven, which can cause uneven fixing.

Accordingly, in order to reduce frictional resistance between a fixing film and a film support member that contacts the inner surface of the fixing film, Japanese Patent Application Laid-Open No. 6-003982 discusses a fixing apparatus in which the film support member is provided with either ribs or holes that decrease the size of the sliding surface of the film support member with the fixing film. However, using the film support member (film guide) discussed in Japanese Patent Application Laid-Open No. 6-003982 in the fixing apparatus described above has the following problems. Specifically, during the fixing process, uneven gloss can occur in the region in which the portion where the heating film guide contacts the heating film and the portion where the pressure film guide contacts the pressure film overlap in the longitudinal direction of the heating roller.

SUMMARY OF THE INVENTION

The present invention is directed to a fixing apparatus that stably rotates a film in the fixing apparatus while simultaneously reducing uneven gloss, and an image forming apparatus including the fixing apparatus.

According to an aspect disclosed herein, a fixing apparatus for fixing a toner image on a recording material while conveying the recoding material bearing the toner image at a nip portion includes a roller, a first unit configured to heat the roller, the first unit including a first tubular film, a heating portion forming member to contact an inner surface of the first tubular film and to form a heating portion with the roller via the first tubular film, and a first guide member dotted with first protruding portions contacting the inner surface of the first tubular film in a generatrix direction of the first tubular film, and a second unit configured to form the nip portion with the roller, the second unit including a second tubular film, a nip portion forming member to contact an inner surface of the second tubular film and to form the nip portion with the roller via the second tubular film, and a second guide member dotted with second protruding portions contacting the inner surface of the second tubular film in a generatrix direction of the second tubular film, wherein there is an area where the first protruding portions and the second protruding portions do not overlap in a generatrix direction of the roller According to another aspect disclosed herein, an image forming apparatus for forming a toner image on a recording material includes an image forming unit configured to form the toner image on the recording material, and a fixing unit configured to fix the toner image on the recording material while conveying the recording material bearing the toner image at a nip portion, the fixing unit including a roller, a first unit configured to heat the roller, the first unit including a first tubular film, a heating portion forming member to contact an inner surface of the first tubular film and to form a heating portion with the roller via the first tubular film, and a first guide member dotted with first protruding portions contacting the inner surface of the first tubular film in a generatrix direction of the first tubular film, a second unit configured to form the nip portion with the roller, the second unit including a second tubular film, a nip portion forming member to contact an inner surface of the second tubular film and to form the nip portion with the roller via the second tubular film, and a second guide member dotted with second protruding portions contacting the inner surface of the second tubular film in a generatrix direction of the second tubular film, and a reversing unit configured to, after a toner image formed on one side of the recording material has been fixed, reverse the recording material to form a toner image on the other side of the recording material and perform fixing processing, wherein there is an area where the first protruding portions and the second protruding portions do not overlap in a generatrix direction of the roller.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6A illustrates positions of film guides according to comparative examples, FIG. 6C illustrates uneven gloss ranks in one-sided printing and in two-sided printing according to comparative examples.

FIG. 7A illustrates positions of film guides according to the exemplary embodiment, FIG. 7C illustrates uneven gloss ranks in one-sided printing and in two-sided printing according to the exemplary embodiment.

DESCRIPTION OF THE EMBODIMENTS

Various exemplary embodiments, features, and aspects of the invention will be described in detail below with reference to the drawings.

Figure 1:
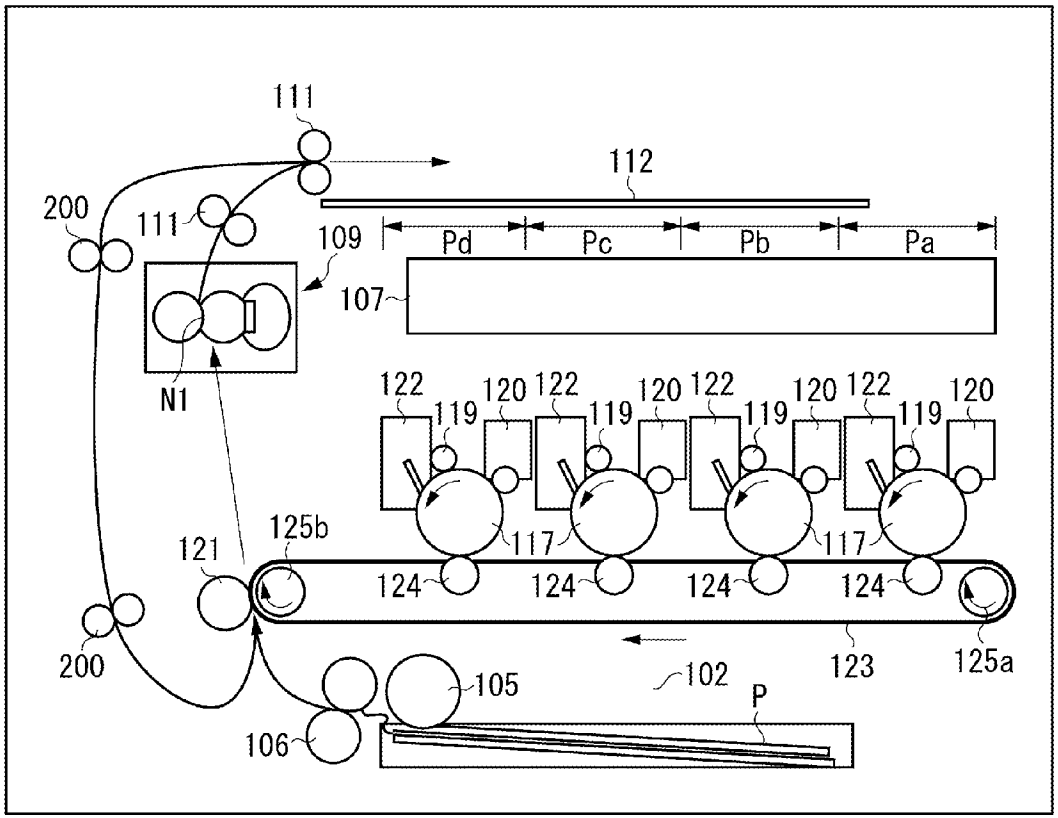
FIG. 1 is a cross-sectional side view of an image forming apparatus according to an exemplary embodiment.

FIG. 1 is a cross-sectional view of an image forming apparatus in which a fixing apparatus according to an exemplary embodiment of the present invention is mounted. The image forming apparatus is an electrophotographic laser beam printer.

The image forming apparatus according to the present exemplary embodiment is an inline-type apparatus in which first to fourth image forming units Pa, Pb, Pc, and Pd that form toner images using cyan, magenta, yellow, and black color toners, respectively, as a developing agent, are arranged in a line in a predetermined direction. These image forming units Pa, Pb, Pc, and Pd each include an electrophotographic photosensitive body (hereinafter, a "photosensitive drum") 117 as an image carrier.

Each image forming unit Pa to Pd is provided with a drum charging device 119 as a charging member and a scanning exposure apparatus 107 as an exposure unit around an outer circumferential surface of the photosensitive drum 117. Further, a developing device 120 as a developing unit and a drum cleaner 122 are provided near the surface of the photosensitive drum 117. An intermediate transfer belt 123 as an intermediate carrier member is provided so as to straddle the photosensitive drum 117. This intermediate transfer belt 123 is stretched between a drive roller 125*a* and a secondary transfer counter roller 125*b*.

A primary transfer roller 124 as a first transfer member is provided on an inner circumferential surface side of the intermediate transfer belt 123 so as to sandwich the intermediate transfer belt 123 with the respective photosensitive drum 117. A secondary transfer roller 121 as a second transfer member is provided on an outer circumferential surface side of the intermediate transfer belt 123 so as to sandwich the intermediate transfer belt 123 with the secondary transfer counter roller 125*b*.

In the image forming apparatus according to the present exemplary embodiment, a control unit 101 executes a predetermined image forming sequence according to a print command output from a (not illustrated) external apparatus, such as a host computer, a terminal device on a network, an external scanner, and the like. The control unit 101 includes a central processing unit (CPU), a read-only memory (ROM), a random access memory (RAM), for example. Various programs necessary for the image forming sequence and image formation are stored in the control unit 101.

The image forming operation of the image forming apparatus according to the present exemplary embodiment will be described with reference to FIG. 1. The control unit 101 sequentially drives each of the image forming units Pa, Pb, Pc, and Pd based on an image forming sequence that is executed according to a print command. First, each photosensitive drum 117 is rotated in the direction of the arrow at a predetermined circumferential speed (process speed), and the intermediate transfer belt 123 is rotated in the direction of the arrow at a circumferential speed that corresponds to the rotational circumferential speed of the each photosensitive drum 117 by the drive roller 125*a*.

At the image forming unit Pa for the first color cyan, the photosensitive drum 117 surface is uniformly charged to a predetermined polarity and potential by the drum charging device 119. Next, the scanning exposure apparatus 107 scans and exposes the charging surface of the photosensitive drum 117 with laser light according to image information output from the external apparatus. Consequently, an electrostatic latent image according to the image information is formed on the changing surface of the photosensitive drum 117 surface. This electrostatic latent image is then developed using cyan toner by the developing device 120. Consequently, a cyan toner image is formed on the photosensitive drum 117 surface.

Similar charging, exposure, and developing steps are each performed for the image forming unit Pb for the second color magenta, the image forming unit Pc for the third color yellow, and the image forming unit Pd for the fourth color black. The color toner images formed on the respective photosensitive drum 117 surfaces are superimposed over each other in order and transferred onto the intermediate transfer belt 123 at a primary transfer nip portion that is formed where the surface of the photosensitive drum 117 and the surface of the intermediate transfer belt 123 contact. Consequently, a full color toner image is borne on the intermediate transfer belt 123 surface.

Residual transfer toner remaining on the photosensitive drum 117 surface after the toner images have been transferred is removed with a drum cleaner 122, and recycled to form the next image.

On the other hand, a recording material P, such as a recording paper, is fed one by one by a feed roller 105 from a feeding cassette 102 and conveyed to a registration roller 106. This recording material P is conveyed by the registration roller 106 to a secondary transfer nip portion that is formed where the surface of the intermediate transfer belt 123 and the surface of the secondary transfer roller 121 contact.

In this conveyance process, the toner image on the intermediate transfer belt 123 surface is transferred onto the recording material P at the secondary transfer nip portion. Consequently, an unfixed full color toner image is borne on the recording material P.

The recording material P bearing the full color toner image is fed into a below-described fixing nip portion N1 of a fixing apparatus 109. Further, heat and pressure are applied on the toner image by this fixing nip portion N1 while the recording material P is conveyed. Consequently, the toner image on the recording material P is fixed on the recording material P.

When forming an image on only a first surface of the recording material, the recording material P that has exited the fixing nip portion N1 is discharged onto a discharge tray 112 by a discharge roller 111.

Next, a case will be described in which, following image formation on the first surface of the recording material in the image forming apparatus, image formation is performed on a second surface, which is the surface on the reverse side to the first surface. After the fixing processing of the first surface of the recording material has finished, the recording material is guided toward a two-sided path along which the recording material is conveyed by a two-sided conveyance roller 200 by conveying the recording material to a predetermined position with the discharge roller 111 and then rotating the discharge roller 111 in the reverse direction. Thus, the image forming apparatus according to the present exemplary embodiment includes a reversing unit that reverses the front and back of the recording material in order to automatically form an image on both sides of the recording material. After this, fixing processing is performed on the recording material that has been reversed by the reversing unit to form the toner image on the second surface at the secondary transfer nip portion, and the recording material is then discharged onto the discharge tray 112 by the discharge roller 111.

In the following description, regarding the fixing apparatus and the members including the fixing apparatus, the longitudinal direction is the direction orthogonal to the recording material conveyance direction on the surface of the recording material, and the short direction is the direction parallel to the recording material conveyance direction. The dimension in the longitudinal direction indicates length, and the dimension in the short direction indicates width.

Figure 2:
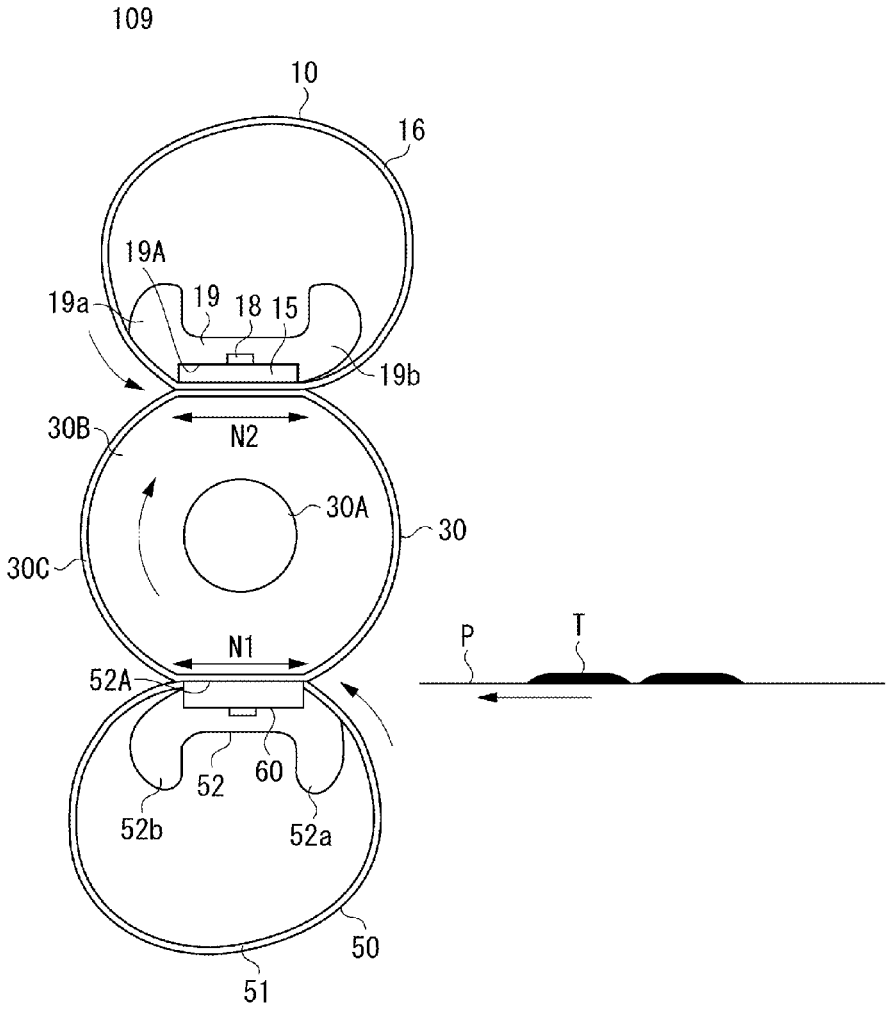
FIG. 2 is a cross-sectional view illustrating a schematic configuration of a fixing apparatus according to an exemplary embodiment.
Figure 3:
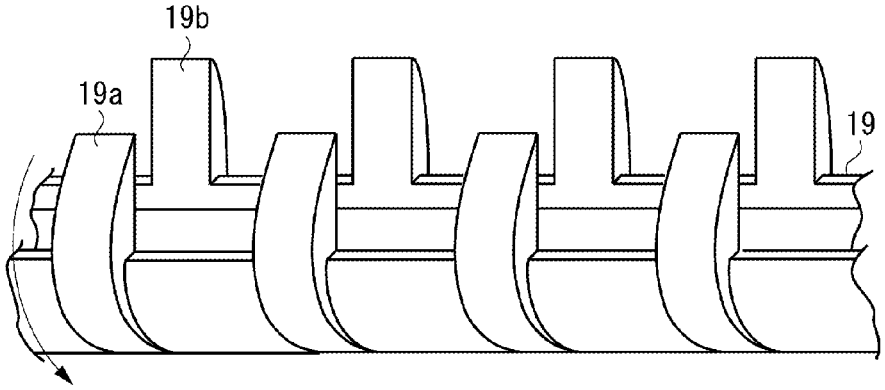
FIG. 3 is a perspective view of a heating film guide in a fixing apparatus according to an exemplary embodiment.
Figure 4:
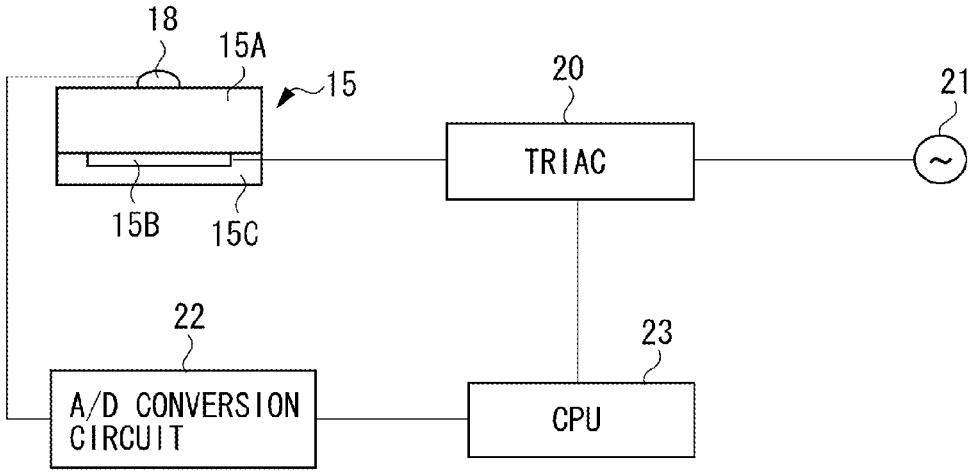
FIG. 4 illustrates a power control system in a fixing apparatus according to an exemplary embodiment.

FIG. 2 is a schematic cross-sectional view of the fixing apparatus (fixing unit) 109 according to the present exemplary embodiment. FIG. 3 is a schematic diagram illustrating upstream ribs 19*a* and downstream ribs 19*b* of a heating film guide 19. FIG. 4 is an explanatory diagram illustrating a ceramic heater 15 and a power control system. This fixing apparatus 109 is an external heating type fixing apparatus.

The fixing apparatus 109 according to the present exemplary embodiment includes a heating roller 30 as a heated rotating body, a heating unit 10 as a heating device (first unit), and a pressure unit 50 as a backup unit (second unit). The heating roller 30 is a member that is long in the longitudinal direction.

The heating roller 30 includes a cylindrical shaft-shaped metal core 30A formed from a metal material such as iron, steel use stainless (SUS), or aluminum. An elastic layer 30B having silicone rubber or the like as a main component is formed on the outer circumferential surface of this metal core 30A. A release layer 20C having polytetrafluoroethylene (PTFE), a tetrafluoroethylene-perfluoroalkyl (PFA) vinyl ether copolymer, a tetrafluoroethylene-hexafluoropropylene (FEP) copolymer or the like as a main component is formed on the outer circumferential surface of this elastic layer 30B.

This heating roller 30 is rotatably supported at both end portions in the longitudinal direction of the metal core 30A via (not illustrated) bearings on (not illustrated) side plates on both sides in the longitudinal direction of an apparatus frame.

The heating unit 10 includes a ceramic heater (hereinafter, "heater") 15, a heating film 16 as a first tubular film, and a heating film guide 19 as a first guide member. The heating film guide 19 is formed using a predetermined heat-resistant material so that its cross-section has an approximately U-shape. Each end portion in the longitudinal direction of the heating film guide 19 is supported on a side plate on both sides in the longitudinal direction of the apparatus frame. The heater 15 is supported in a groove 19A provided on a flat surface of the heating film guide 19 along the longitudinal direction of the heating film guide 19. The heating film 16 is externally fitted loosely to the heating film guide 19 that is supported by the heater 15. The heater 15, the heating film 16, and the heating film guide 19 are all members that are long in the longitudinal direction.

The heater 15 includes a thin-plate shaped heater substrate 15A that has a ceramic material, such as alumina or aluminum nitride, as a main component. On the surface on the heating film 16 side of this heater substrate 15A, a heat generating resistor 15B having silver, palladium or the like as a main component is provided along the longitudinal direction of the heater substrate 15A. Further, on the surface of this heater substrate 15A, a protective layer 15C having glass or a heat-resistant resin such as a fluororesin, polyimide and the like, as a main component is provided so as to cover the heat generating resistor 15B.

The heating film 16 is formed so that the inner circumferential length of the heating film 16 is longer than the outer circumferential length of the heating film guide 19 by a predetermined length. The heating film 16 is externally fitted loosely under no tension to the heating film guide 19. As the layer structure of the heating film 16, a bi-layer structure is employed in which the outer circumferential surface of an endless belt-shaped substrate having polyimide as a main component is covered by an endless belt-shaped surface layer having PFA as a main component.

This heating unit 10 is arranged parallel to the heating roller 30. Further, both end portions in the longitudinal direction of the heating film guide 19 are urged in the direction orthogonal to the generatrix direction of the heating film 16 with respect to the heating roller 30 by a (not illustrated) pressure spring. The outer circumferential surface of the protective layer 15C of the heater 15 is pressed against the outer circumferential surface of the heating roller 30 via the heating film 16. Consequently, the elastic layer 30B of the heating roller 30 is pressed and elastically deformed at the outer surface of the protective layer 15C of the heater 15, so that a heating portion N2 having a predetermined width is formed by the heating roller 30 surface and the outer circumferential surface of the heating film 16. Thus, the heating portion N2 is formed by the heating roller 30 and the heater 15, via the heating film 16. Therefore, the heater 15 also acts as a heating portion forming member.

The pressure unit 50 includes a pressure film 51 as a second tubular film, a pressure film guide 52 as a second guide member, and nip forming member 60. The pressure film guide 52 is formed using a predetermined heat-resistant material so that its cross-section has an approximately U-shape.

The nip forming member 60 is supported in a groove 52A provided on a flat surface of the heating film guide 19 along the longitudinal direction of the heating film guide 19.

Each end portion in the longitudinal direction of the pressure film guide 52 is supported on a side plate on both sides in the longitudinal direction of the apparatus frame. The pressure film 51 is externally fitted to the pressure film guide 52. The pressure film 51 and the pressure film guide 52 are both members that are long in the longitudinal direction.

The pressure film 51 is formed so that the inner circumferential length of the pressure film 51 is longer than the outer circumferential length of the pressure film guide 52 by a predetermined length. The pressure film 51 is externally fitted loosely under no tension to the pressure film guide 52. As the layer structure of the pressure film 51, a bi-layer structure is employed in which the outer circumferential surface of an endless belt-shaped substrate having polyimide as a main component is covered by an endless belt-shaped surface layer having PFA as a main component.

This pressure unit 50 is arranged parallel to the heating roller 30. Further, both end portions in the longitudinal direction of the pressure film guide 52 are urged in the direction orthogonal to the generatrix direction of the heating roller 30 by a (not illustrated) pressure spring. The nip forming member 60 of the pressure unit 50 is pressed against the outer circumferential surface of the heating roller 30 via the pressure film 51. Consequently, the elastic layer 30B of the heating roller 30 is pressed and elastically deformed at the outer surface of the nip forming member 60, so that a fixing nip portion N1 having a predetermined width is formed by the surface of the heating roller 30 and the outer circumferential surface of the pressure film 51. Thus, the fixing nip portion N1 is formed by the heating roller 30 and the nip forming member 60, via the pressure film 51.

Operation of the fixing apparatus 109 will now be described with reference to FIGS. 2 and 4. The control unit 101 rotatably drives a drive motor M acting as a drive source based on an image forming sequence executed according to a print command. The rotation of the power shaft of this drive motor M is transmitted to the metal core 30A of the heating roller 30 via a (not illustrated) predetermined gear train. Consequently, the heating roller 30 rotates in the direction of the arrow at a predetermined circumferential speed (process speed). The rotation of the heating roller 30 is transmitted to the pressure film 51 by a frictional force produced between the surface of the heating roller 30 and the surface of the pressure film 51. Consequently, the pressure film 51 is rotated in the direction of the arrow along with the heating roller 30 while the inner circumferential surface of the pressure film 51 slides with the nip forming member 60 of the pressure film guide 52. Further, the drive force of the heating roller 30 is transmitted to the heating film 16 as a frictional force produced between the surface of the heating roller 30 and the surface of the heating film 16 at the heating portion N2.

Consequently, the heating film 16 is rotated in the direction of the arrow along with the heating roller 30 while the inner circumferential surface of 16 slides with the outer circumferential surface of the protective layer 15C of the heater 15.

Further, the control unit 101 turns on a triac 20 as a power control unit based on the image forming sequence. The triac 20 starts the supply of power to heat generating resistor 15B of the heater 15 by controlling the power applied from an AC power source 21. The heat generating resistor 15B generates heat based on the supply of power, which causes the temperature of the heater 15 to rapidly increase, so that the heating film 16 heats up. The temperature of the heater 15 is detected by a thermistor 18 as a temperature detecting member that is provided above the surface on the heating film guide 19 side of the heater substrate 15A. The control unit 101 receives an output signal (temperature detection signal) from the thermistor 18 via an A/D conversion circuit 22, and controls the triac 20 so that the heater 15 maintains a predetermined target temperature based on this output signal. Consequently, the temperature detected by the thermistor 18 is maintained at the predetermined target temperature.

The surface of the rotating heating roller 30 is heated by the supply of heat from the heater 15 at the heating portion N2 via the heating film 16. The amount of heat supplied from the heater 15 to the surface of the heating roller 30 is an amount that is enough to fix an unfixed toner image T borne by the recording material P. In a state in which the drive motor M is rotatably driven and the heater 15 is maintained at the target temperature, the recording material P bearing the unfixed toner image T is fed and conveyed into the fixing nip portion N1 with the surface bearing the toner image facing the heating roller 30. The toner image T melts due to the heat during the conveyance process of the recording material at the fixing nip portion N1. At the same time, pressure is applied onto the toner image T. Consequently, the toner image T is fixed onto the recording material P.

The shape of the heating film guide 19 and the pressure film guide 52, and the drive torque of the fixing apparatus, will now be described.

As illustrated in FIG. 3, the heating film guide 19 includes a plurality of upstream ribs 19*a* (first ribs) as first protruding portions extended in an opposite direction to the rotating direction of the heating film 16 at an upstream area from the heating portion N2. Further, the heating film guide 19 includes a plurality of downstream ribs 19*b* extended in the rotating direction of the heating film 16 at a downstream area from the heating portion N2. The rotating direction of the heating film 16 is the direction indicated by the arrow in FIG. 3.

The pressure film guide 52 includes a plurality of upstream ribs 52*a* (second ribs) as second protruding portions extended in an opposite direction to the rotating direction of the pressure film 51 at an upstream area from the fixing nip portion N1. Further, the pressure film guide 52 includes a plurality of downstream ribs 52*b* extended in the rotating direction of the pressure film 51 at a downstream area from the fixing nip portion N1.

In the following description, the upstream ribs 19*a*, the downstream ribs 19*d*, the upstream ribs 52*a*, and the downstream ribs 52*b* will collectively be referred to as "ribs". Similarly, the 19 and the pressure film guide 52 will collectively be referred to as a "film guide", and the heating film 16 and the pressure film 51 will collectively be referred to as a "film".

The ribs of the film guide are formed so that the portions contacting the film (the tips of the ribs) are dotted in the generatrix direction of the film. This is so that the ribs guide the rotation of the film while contacting the inner surface of the film with the minimum surface area.

If the contact surface area between the film guide and the film inner surface is large, the sliding resistance when the film rotates can increase. Especially in a configuration where grease is coated as a lubricant between the film guide and the film inner surface, if the fixing apparatus starts from a cold state, the sliding resistance produced when the film rotates increases since the portions slide with the grease still being highly viscous. Consequently, film rotation can become unstable. Further, the torque produced when starting the drive of the heating roller 30 increases.

For the above reasons, providing the film guide ribs so as to be dotted in the generatrix direction of the film enables the inner surface of the film to be guided while reducing the sliding resistance of the portions contacting the film guide when the film is rotating.

Figure 5:
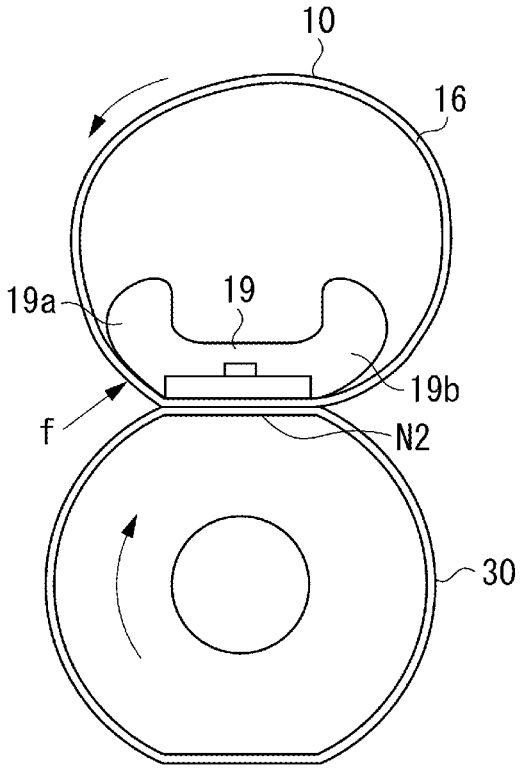
FIG. 5 illustrates rotation behavior of a heating film guide in a fixing apparatus according to an exemplary embodiment.

Next, the relationship between the arrangement of the ribs on the film guide and uneven temperature of the film will be described. At the heating film guide 19, the upstream ribs 19*a* that are upstream from the heating portion N2 contact the inner surface of the heating film 16 more easily than the downstream ribs 19*b* that are downstream from the heating portion N2. This is because, upstream from the heating portion N2, the heating film 16 is pulled by the heating portion N2, so that as illustrated in FIG. 5, a tensile force f acts on the heating film 16. Downstream from the heating portion N2, the heating film 16 is pushed out by the heating portion N2, producing slack. Consequently, the inner surface of the heating film 16 either does not contact the downstream ribs 19*a*, or even if the inner surface does contact these ribs, the contact pressure with the heating film 16 is smaller than that for the upstream ribs 19*a*.

Similar to the heating film guide 19, at the heating film guide 19 too, the upstream ribs 52*a* that are upstream from the fixing nip portion N1 contact the inner surface of the pressure film 51 more easily than the downstream ribs 52*b* that are downstream from the fixing nip portion N1. This is because, upstream from the fixing nip portion N1, the pressure film 51 is pulled by the fixing nip portion N1, so that a tensile force acts on the pressure film 51. Downstream from the fixing nip portion N1, the pressure film 51 is pushed out by the fixing nip portion N1, producing slack. Consequently, the inner surface of the pressure film 51 either does not contact the downstream ribs 52*a*, or even if the inner surface does contact these ribs, the contact pressure with the pressure film 51 is smaller than that for the upstream ribs 52*a*.

If the ribs contact the heated film inner surface, the heat of the film is lost to the ribs, so that, of the film inner surface, the temperature of the portion contacting the ribs falls below that of the portion not in contact.

Therefore, when the heating film 16 is rotated, of the heating film 16, the temperature of the portion contacting the upstream ribs 19*a* that are upstream from the heating portion N2 falls below that of the portion not in contact. Specifically, of the heating film 16, the temperature of the portion corresponding to the upstream ribs 19*a* of the heating film guide 19 is lower than the temperature of the portion corresponding to non-contact portions between the upstream ribs 19*a* and 19*b*, so that an uneven temperature occurs in the generatrix direction (longitudinal direction) of the heating film 16.

For the pressure film 51 too, for the same reasons as the heating film 16, the temperature of the pressure film portion contacting the upstream ribs 52*a* of the pressure film guide 52 falls below that of the portion not in contact, so that an uneven temperature occurs in the generatrix direction (longitudinal direction) of the heating film 16.

In the present exemplary embodiment, since there is no heat source directly heating the pressure film 51, this means that an uneven temperature occurs when the pressure film 51 heats up while rotating in contact with the heating roller 30.

Figure 6B:
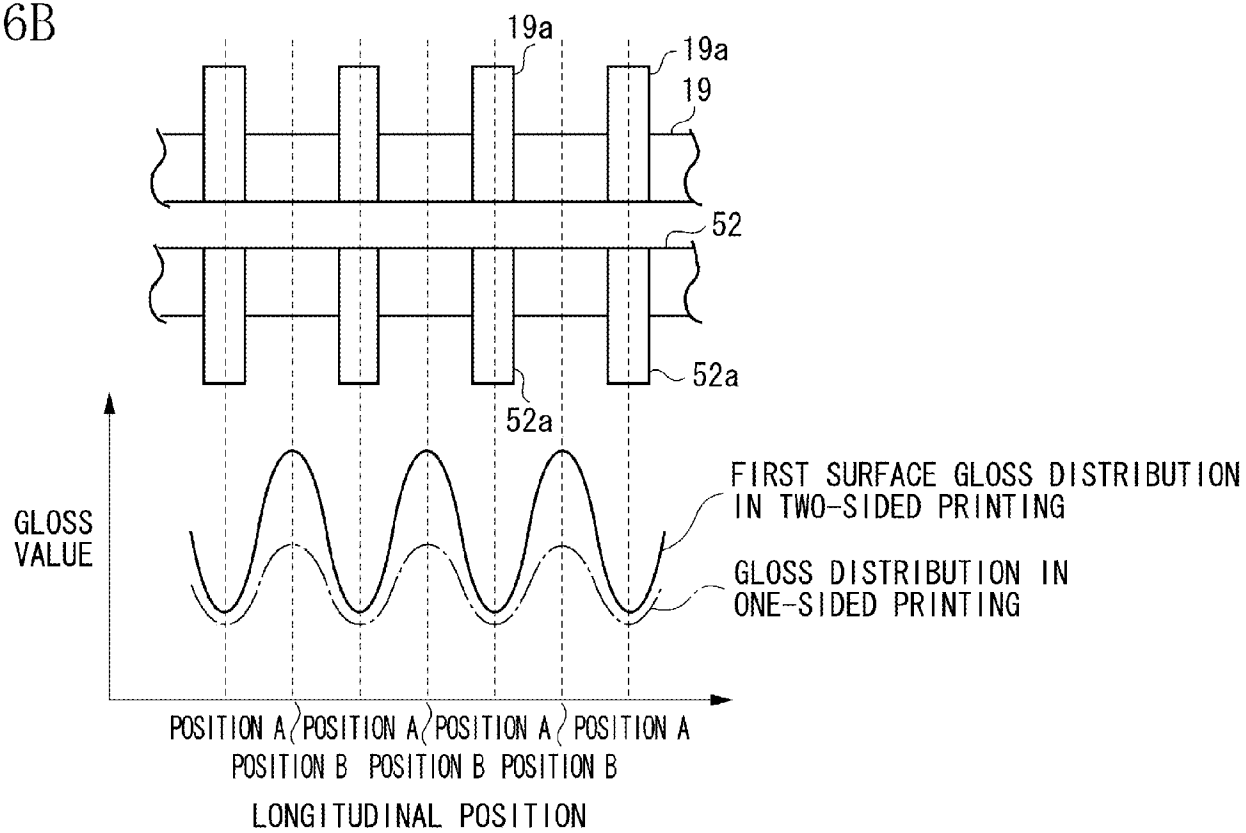
FIG. 6B illustrates a relationship between rib positions and gloss distributions according to comparative examples.

Next, a relationship between the position of the ribs of the film guide and uneven gloss of the image on the recording material will be described with a fixing apparatus according to comparative examples. FIG. 6A is a table illustrating positions of the ribs of the heating film guide 19 and the pressure film guide 52 according to comparative examples 1 to 4. FIG. 6B illustrates the positions in the longitudinal direction of the upstream ribs 19*a* of the heating film guide 19 and the upstream ribs 52*a* of the pressure film guide 52, and the distributions of gloss values in the direction orthogonal to the conveyance direction of the recording material. FIG. 6C illustrates the ranks of uneven gloss on a first surface in one-sided printing and in two-sided printing according to comparative examples 1 to 4. The recording material P used to rank uneven gloss of the image was Presentation Paper 130 g, which is glossy paper manufactured by Hewlett-Packard.

The rank evaluation was performed by visually observing the trailing edge area of an image when a solid image was printed over the whole of a first surface of the recording material. The uneven gloss ranks were evaluated in three stages: a level at which uneven gloss is visually unnoticeable (○); a level at which uneven gloss is close to the visual detection limit (Δ); and a level at which uneven gloss is easily noticed visually (x).

In the comparative examples, a position where ribs were provided at equal intervals (30 mm) in the longitudinal direction is referred to as position A, and a position where ribs were provided between the ribs in position A is referred to as position B. The rib width is 2 mm.

In all of comparative examples 1 to 4, the position in the longitudinal direction of the upstream ribs 19*a* of the heating film guide 19 and the upstream ribs 52*a* of the pressure film guide 52 are the same, position A (as illustrated in FIG. 6B).

In comparative example 1, the position in the longitudinal direction of the downstream ribs 19*b* of the heating film guide 19 and the downstream ribs 52*b* of the pressure film guide 52 are the same, position A. Specifically, the downstream ribs 19*b* overlap with the downstream ribs 52*b* in the generatrix direction of the heating roller 30. In comparative example 2, although the upstream ribs 52*a* of the pressure film guide 52 are at position A, the downstream ribs 52*b* are at position B (between the ribs in position A). In comparative example 3, the position of the upstream ribs 19*a* and the downstream ribs 19*b* of the heating film guide 19 is different. In comparative example 4, the position of the upstream ribs 52*a* and the downstream ribs 52*b* of the pressure film guide 52 is different, and the position of the upstream ribs 19*a* and the downstream ribs 19*b* of the heating film guide 19 is different.

In the fixing apparatuses according to comparative examples 1 to 4, there was no level difference in the uneven gloss ranks of the images that had been subjected to fixing processing. In all of these comparative examples, in one-sided printing, uneven gloss was produced at a level close to the limit that could be confirmed visually, and in two-sided printing, uneven gloss was produced a level easily confirmed visually.

Based on the above results, since there is no change in the uneven gloss rank among comparative examples 1 to 4, it can be seen that the degree of influence that the position of the downstream ribs of the heating film guide 19 and the pressure film guide 52 has on uneven gloss is small. This is thought to be because, as described above, since the downstream ribs either do not contact the inner surface of the film, or even if they do contact the inner surface, the contact pressure is weak, the film heat is less likely to be lost.

Next, the relationship between the position of the upstream ribs of the film guide and uneven gloss will be considered. In all of comparative examples 1 to 4, the position in the longitudinal direction of the upstream ribs 19*a* of the heating film guide 19 and the upstream ribs 52*a* of the pressure film guide 52 are the same, position A. Therefore, in the longitudinal direction there is unevenness in the total heat amount that is conferred to the recording material at the fixing nip portion N1.

This mechanism will now be described. On the heating roller 30, an uneven temperature occurs in the longitudinal direction due to the influence of uneven temperature in the longitudinal direction produced between the portion of the heating film 16 contacting the upstream ribs 19*a* of the heating film guide 19 and the portion that is not contacting the upstream ribs 19*a*. On the pressure film 51, an uneven temperature in the longitudinal direction occurs between the portion contacting the upstream ribs 52*a* of the pressure film guide 52 and the portion that is not contacting the upstream ribs 52*a*. Therefore, during fixing processing at the fixing nip portion N1, if the uneven temperature of the heating roller 30 and the uneven temperature of the pressure film 51 have a matching phase in the generatrix direction of the pressure roller 30, unevenness in the longitudinal direction of the heat amount conferred to the recording material increases. The phase of the uneven temperature refers to the repetition of a portion having a high temperature and a portion having a low temperature.

This unevenness in the longitudinal direction of the heat amount conferred to the recording material at the fixing nip portion N1 can cause uneven gloss in the image. Specifically, comparing the gloss in the portion on the recording material corresponding to the upstream ribs 19*a* of the heating film guide 19 and the gloss in the portion on the recording material corresponding to between the upstream ribs 19*a*, it can be seen that the former case has less gloss than the latter case.

In one-sided printing, uneven gloss is more noticeable on a thin recording material than on a thick recording material. This is because heat is more easily transmitted in the thickness direction if the recording material is thin, so that the recording material is more likely to receive the effects of unevenness in the amount of heat conferred from the pressure film 51 side.

Further, in two-sided processing, as illustrated in FIG. 6B, the uneven gloss produced during the fixing processing of the first surface of the recording material can be amplified and become worse than in one-sided printing, with the degree of gloss increased by re-heating and re-melting during the fixing processing of the second surface. Specifically, comparing the degree of increase in the gloss in the portion on the recording material corresponding to the upstream ribs 52*a* of the pressure film guide 52 and the gloss in the portion on the recording material corresponding to the portion between the upstream ribs 52*a*, it can be seen that the former case has a smaller degree of increase than the latter case.

Next, the fixing apparatus according to the present exemplary embodiment will be described with reference to FIG. 7. In the present exemplary embodiment, to suppress uneven gloss, the position in the longitudinal direction of the upstream ribs 19*a* of the heating film guide 19 and the upstream ribs 52*a* of the pressure film guide 52 is configured so that the ribs do not overlap in the area where the paper sheet passes. Specifically, as illustrated in FIG. 7A, the upstream ribs 19*a* of the heating film guide 19 are provided at position A in the longitudinal direction, and the upstream ribs 52*a* of the pressure film guide 52 are provided at position B in the longitudinal direction. Namely, the upstream ribs 19*a* and the upstream ribs 52*a* are positioned alternately in the generatrix direction of the heating roller 30. Other than this, the configuration of the fixing apparatus is the same as in comparative examples 1 to 4, and thus a description thereof will be omitted here.

Figure 7B:
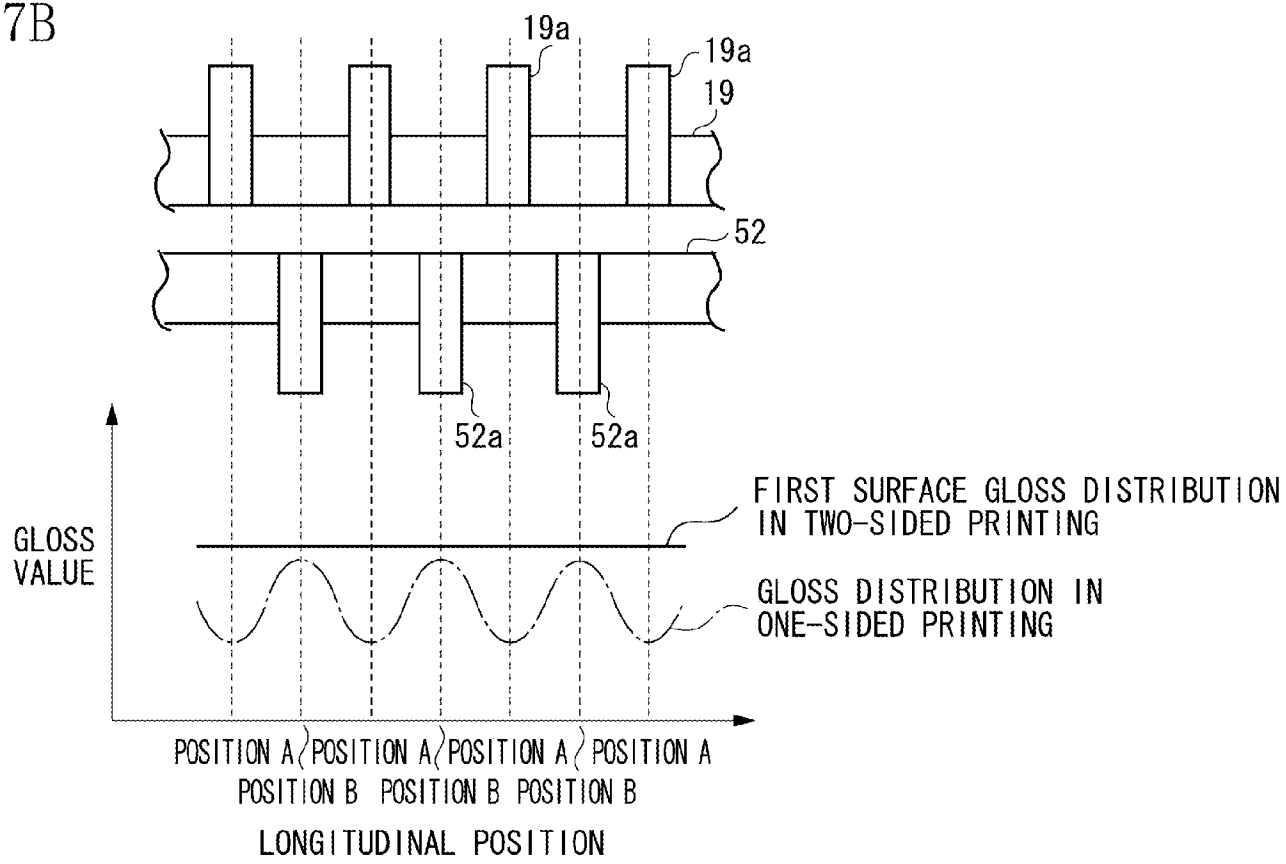
FIG. 7B illustrates a relationship between rib positions and gloss distributions according to the exemplary embodiment.

FIG. 7B is an image diagram illustrating the positions in the longitudinal direction of the upstream ribs 19*a* of the heating film guide 19 and the upstream ribs 52*a* of the pressure film guide 52, and the gloss distributions in the longitudinal direction of the recording material, according to the present exemplary embodiment.

FIG. 7C illustrates the results of ranking uneven gloss in one-sided printing and in two-sided printing based on visual observation. Since the type of recording material used in the experiments, and the method for confirming the level of uneven gloss, are the same as in the comparative examples, a description thereof will be omitted here.

From FIG. 7C, it can be seen that in the exemplary embodiment too, similar to the comparative examples, there is no change in the uneven gloss rank depending on the position of the upstream ribs of the film guide. This is thought to be because, for the same reason described in the comparative examples, the position of the upstream ribs has little effect on uneven gloss in the image.

In the configuration according to the exemplary embodiment, the uneven gloss rank was a level at which uneven gloss could not be visually confirmed for either one-sided printing or two-sided printing, and had thus improved compared with the comparative examples. The mechanism of this improvement in uneven gloss will now be described.

Like with comparative examples 1 to 4, on the heating roller 30, an uneven temperature occurs in the longitudinal direction due to the influence of an uneven temperature in the longitudinal direction produced between the portion of the heating film 16 contacting the upstream ribs 19*a* of the heating film guide 19 and the portion that is not contacting the upstream ribs 19*a*. On the pressure film 51 too, an uneven temperature in the longitudinal direction occurs between the portion contacting the upstream ribs 52*a* of the pressure film guide 52 and the portion that is not contacting the upstream ribs 52*a*.

However, in the exemplary embodiment, during the fixing processing at the fixing nip portion N1, the uneven temperature of the heating roller 30 and the uneven temperature of the pressure film 51 have opposite phases, so that unevenness in the longitudinal direction of the heat amount conferred to the recording material at the fixing nip portion N1 is suppressed. Therefore, in one-sided printing, unevenness is suppressed because there is no amplification of unevenness in the longitudinal direction of the heat amount conferred to the recording material.

In addition, in two-sided printing, when performing fixing processing on the second surface of the recording material, the gloss changes in a direction that cancels out the uneven gloss produced when the fixing processing was performed on the first surface, so that the uneven gloss on the first surface is reduced. Therefore, the effects of suppressing uneven gloss are especially large.

Further, two-sided printing of the recording material is not limited to automatic printing in the apparatus like in the present exemplary embodiment. Two-sided printing can be performed by the user setting in the feeding cassette a recording material printed on only the first surface and then discharged, so that the recording material is printed on the second surface.

Further, the present invention is not limited to positioning the upstream ribs of the heating film guide and the upstream ribs of the pressure film guide so that there is no overlap in the longitudinal direction like in the present exemplary embodiment. As long as there is at least an area in which these ribs do not overlap, there is an effect of suppressing uneven gloss at that portion.

An uneven temperature in the longitudinal direction of the heating roller can cause the outer diameter of the heating roller to change, and also the conveyance properties of the recording material at the nip portion to change. Especially, if the outer diameter of the end portions of the heating roller becomes smaller than the outer diameter of the center portion due to an uneven temperature in the longitudinal direction of the heating roller, wrinkles can be produced in the recording material.

Accordingly, embodiments of the present invention can be configured so that the position of the upstream ribs of the heating film guide and the position of the upstream ribs of the pressure film guide do not overlap in the generatrix direction of the heating roller for only the area corresponding to both end portions of the heating roller 30. Such a configuration enables uneven gloss in the end portions to be suppressed while suppressing wrinkles in the recording material, because the temperature of the heating roller end portions is less likely to undergo large localized decreases.

Further, the portion of the film guide contacting the inner surface of the film is not limited to the ribs. There may be some protruding portions contacting the film inner surface when the film is rotating.

Although the present exemplary embodiment is configured without including a heat source in the pressure unit, a heat source may also be included in the pressure unit.

Figure 8:
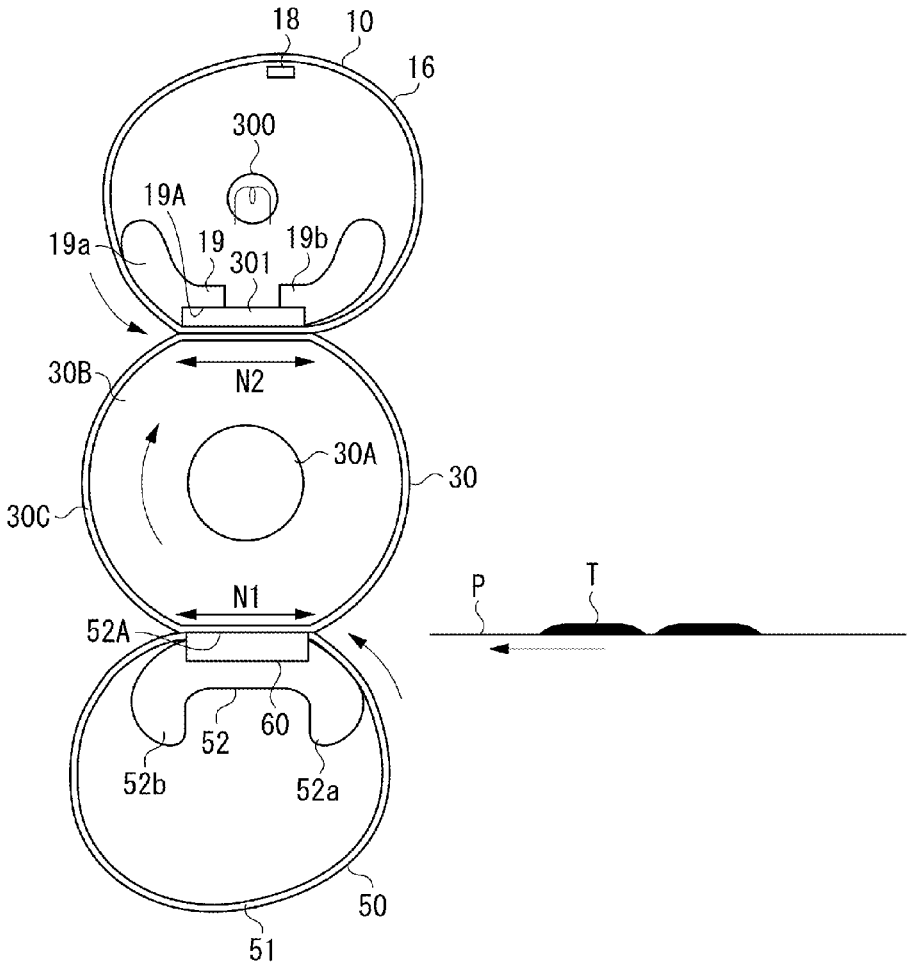
FIG. 8 is a cross-sectional view illustrating a schematic configuration of a fixing apparatus according to a modified example of the exemplary embodiment.

The present invention also includes modified examples of the exemplary embodiment like the following. FIG. 8 is a cross-sectional view of a fixing apparatus according to a modified example. Since the configuration is the same as that of the exemplary embodiment except for the heating unit 10, a description thereof will be omitted here.

The heating unit 10 according to the modified example includes a heater 300 that is embedded in the heating film 16. The heating portion forming member is not a heater, rather it is formed from a metal having a high thermal conductivity, such as aluminum. The heater 300 may also be provided outside the heating film 16, and heat the outer circumferential surface of the heating film 16. Alternatively, the heating film 16 may generate heat by itself, without providing the heater 300.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-063662 filed Mar. 21, 2012, which is hereby incorporated by reference herein in its entirety.

What is claimed is:

1. A fixing apparatus for fixing a toner image on a recording material while conveying the recoding material bearing the toner image at a nip portion, the fixing apparatus comprising:

a roller;

a first unit including a first tubular film contacting the roller and forming a heating portion with the roller, a heater heating the first tubular film, and a first guide member; and a second unit including a second tubular film contacting the roller and forming the nip portion with the roller, and a second guide member, wherein the first guide member includes first protruding portions which contact an inner surface of the first tubular film in a region corresponding to the recording material conveyed at the nip portion in a generatrix direction of the roller, and the second guide member includes second protruding portions which contact an inner surface of the second tubular film in the region, and wherein the apparatus takes first positions in the generatrix direction where the first protruding portions are provided and the second protruding portions are not provided and second positions in the generatrix direction where the first protruding portions are not provided and the second protruding portions are provided.

2. The fixing apparatus according to claim 1, wherein the first protruding portions are ribs extended in a rotating direction of the first tubular film, and wherein the second protruding portions are ribs extended in a rotating direction of the second tubular film.

3. The fixing apparatus according to claim 1, wherein the first protruding portions are at an upstream area from the heating portion in a rotating direction of the first tubular film, and wherein the second protruding portions are at an upstream area from the nip portion in a rotating direction of the second tubular film.

4. The fixing apparatus according to claim 1, wherein the first protruding portions and the second protruding portions are arranged alternately each other in the generatrix direction.

5. The fixing apparatus according to claim 1, wherein the heater contacts the inner surface of the first tubular film and forms the heating portion with the roller via the first tubular film.

6. The fixing apparatus according to claim 1, wherein the second unit includes the nip portion forming member contacting the inner surface of the second tubular film, and wherein the nip portion forming member forms the nip portion with the roller via the second tubular film.

7. A fixing apparatus for fixing a toner image on a recording material while conveying the recoding material bearing the toner image at a nip portion, the fixing apparatus comprising:

a roller;

a first unit including a first tubular film contacting the roller and forming a heating portion with the roller, a heater heating the first tubular film, and a first guide member; and a second unit including a second tubular film contacting the roller and forming the nip portion with the roller, and a second guide member, wherein the first guide member includes first protruding portions which contact an inner surface of the first tubular film in a region corresponding to the recording material conveyed at the nip portion in a generatrix direction of the roller, and the second guide member includes second protruding portions which contact an inner surface of the second tubular film in the region, and wherein the first protruding portions and the second protruding portions are arranged so that first projection images of the first protruding portions, projected on at least part of an area where the recoding material passes on a virtual plane including the nip portion, do not overlap with all of second projection images of the second protruding portions projected on the area on the virtual plane in a case where the first projection images and the second projection images are viewed from a conveyance direction of the recoding material.

* * * * *